United States Patent [19]

McLeod

[11] Patent Number: 4,691,770

[45] Date of Patent: Sep. 8, 1987

[54] WELL CASING PACKER

[76] Inventor: Roderick D. McLeod, 5104 125th Street, Edmonton, Alberta, Canada, T6H 3V5

[21] Appl. No.: 813,927

[22] Filed: Dec. 27, 1985

[30] Foreign Application Priority Data

Apr. 3, 1985 [CA] Canada ..... 478275

[51] Int. Cl.[4] ..... F21B 33/04

[52] U.S. Cl. ..... 166/73; 166/196

[58] Field of Search ..... 166/72, 82, 83, 84, 166/86, 88, 180, 196, 334, 387, 73

[56] References Cited

U.S. PATENT DOCUMENTS

| | | | |
|---|---|---|---|
| 347,277 | 8/1886 | Price et al. | 166/75.1 |
| 546,258 | 9/1895 | Suverkrop | 166/196 X |
| 1,625,378 | 4/1927 | Snodgrass | 166/88 |
| 2,616,504 | 11/1952 | Osmun | 166/83 X |
| 3,392,785 | 7/1968 | King | 166/196 |
| 4,111,261 | 9/1978 | Oliver | 166/86 |

FOREIGN PATENT DOCUMENTS

| | | | |
|---|---|---|---|
| 800827 | 12/1968 | Canada | 166/67 |
| 905846 | 7/1972 | Canada | 166/65 |
| 915576 | 11/1972 | Canada | 166/62 |
| 1020089 | 11/1977 | Canada | 166/67 |
| 1094945 | 2/1981 | Canada | 166/21 |
| 1108526 | 9/1981 | Canada | 166/65 |
| 1144476 | 4/1983 | Canada | 166/65 |
| 245967 | 4/1912 | Fed. Rep. of Germany | 166/88 |

OTHER PUBLICATIONS

*Composite Catalog of Oil Field Equipment and Services* vols. 1 and 2 World Oil, Houston, Tex. 1976–1977, pp. 1873–1876, 1903–1904, 1183–1190.

*Primary Examiner*—Stephen J. Novosad
*Assistant Examiner*—David J. Bagnell
*Attorney, Agent, or Firm*—Hubbard, Thurman, Turner & Tucker

[57] ABSTRACT

An expanding nipple, externally mounted packer has a body which mounts onto a casing head by way of a tubing spool or the like. The body contains the upper ends of a pair of concentric mandrels which are lowered into the well casing. The outer mandrel has a deformable seal on its lower end and the inner mandrel has an expander on its lower end. Means in the body, responsive to hydraulic pressure, raises the inner mandrel with respect to the outer mandrel so that the expander forces the seal outwards against the casing wall.

3 Claims, 3 Drawing Figures

WELL CASING PACKER

FIELD OF THE INVENTION

This invention relates to oil and gas well servicing and specifically to an apparatus for sealing off a spool annulus for servicing.

BACKGROUND OF THE INVENTION

During the servicing of oil and gas wells it is often necessary to pump fluids and slurries down the well at pressures that are greater than the ratings of the associated wellhead equipment such as valves, hangars, spools etc. The wellhead isolation tool or tree saver was developed for the purpose of pumping through wellhead valves and down the well tubing. Tree savers work on wells that are dead or under pressure and have tubing in them. However, there is a large number of wells that must be serviced which do not have tubing in them and the servicing must be done down the casing.

Wells of this type are also dead or have very little pressure and do not have any wellhead valves mounted on them. A tree saver will not work reliably on such wells because conventional tree savers make a seal in the tubing by forcing a nipple with a rubber on the end, into the tubing to thereby seal off the servicing pressures from the wellhead equipment. This is accomplished only because the tubing has a very small manufacturing tolerance with regard to the inside diameter in the area where the nipple seals. A well casing on the other hand has a wide manufacturing tolerance and it is difficult to get a nipple to seal in the casing for the pressures encountered.

Conventionally, the method of servicing down well casing has been to use what is known as a downhole packer. The purpose of the packer is to pump the fluid or slurry down the long string casing without the fluid having access to the tubing spool mounted on top of the casing head. To accomplish this, a packer is lowered into the long string casing on tubing using a service rig such as a Franks 100. The packer is then set by either tension or compression and by turning the tubing. The tubing at the top is then set up so that fluid can be pumped downwardly through the tubing, through the packer and into the lower part of the long string casing. The packer and service rig may be of any of several available makes.

Those skilled in this art will appreciate the fact that pumping fluid down one thousand feet of tubing takes much more power than to pump the fluid down the casing. Testing to make sure that the packer is set entails pumping fluid down the annulus and then taking the pressure up to see if the packer may leak. There is a significant percentage of packer failure in this type of service and pulling out and re-running the packer is very time consuming and very expensive. As an example, the cost to run a downhole packer of the type referred to above would be in the region of twenty-five thousand dollars. The tubing and packer must also be taken out after the job and this may entail a return trip to the well by the whole crew and rig if the servicing job was not done while the rig was on the site.

SUMMARY OF THE INVENTION

The present invention provides significant improvements in the art of well casing packers in providing apparatus that can be put in place by any small hoist truck with a single man and wherein the total cost for installation and extraction can be as low as approximately five thousand dollars. Additionally, the unit is set by a small hydraulic pump at the wellhead rather than by weight of tubing or pulling tension by a rig which must turn the tubing. Only a small volume of fluid is required to test the sealing and a small hoist can be used for easy removal of the unit instead of the use of a large rig.

According to a broad aspect, the invention relates to a short-coupled well casing packer which comprises a body that is adapted for external mounting on a casing head, tubing spool or the like. A pair of concentric mandrels are supported in the body of the apparatus, the inner mandrel being movable axial with respect to the outer mandrel. Sealing means is provided on the lower end of the outer mandrel for circumferentially sealing against the inner wall of a well casing and means are provided on the lower end of the inner mandrel for engaging and expanding the seal. The body includes hydraulic pressure responsive means which is secured to the upper end of the inner mandrel for linearly moving the inner mandrel with respect to the outer mandrel and means are provided for locking the inner mandrel in position relative to the outer mandrel.

BRIEF DESCRIPTION OF THE DRAWINGS

The invention is illustrated by way of example only in the accompanying drawings in which.

DESCRIPTION OF THE PREFERRED EMBODIMENT

Figure 1:
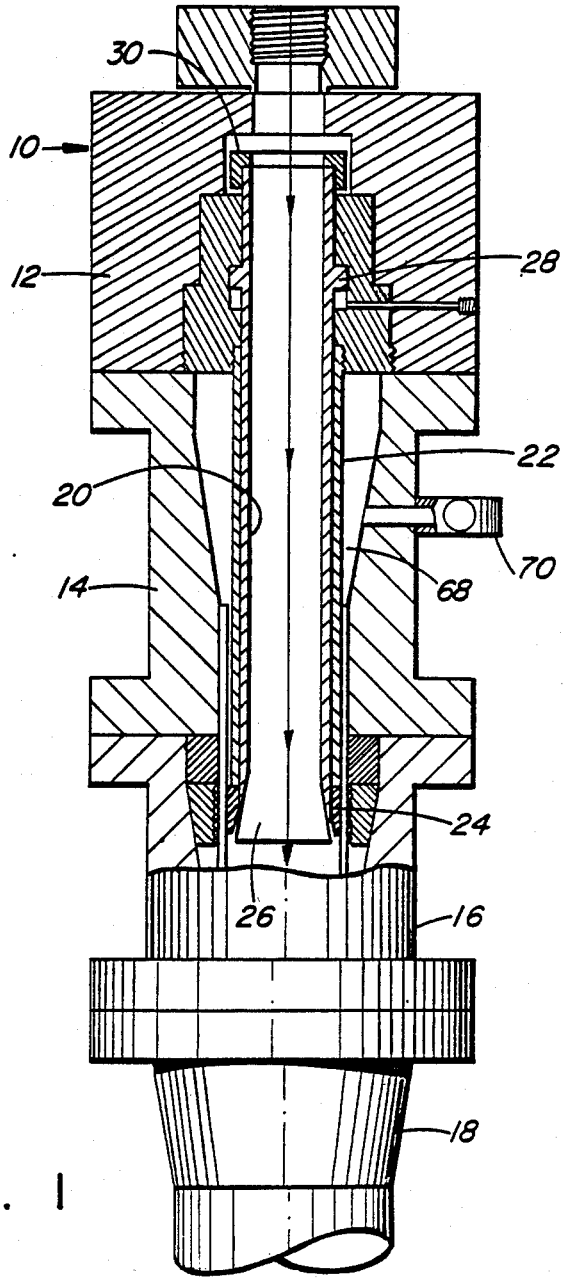
FIG. 1 is a cross sectional, schematic view of the invention installed on a wellhead.

Referring to FIG. 1, the packer illustrated generally at 10 includes a steel body 12 which is externally mounted by suitable bolts, not shown, to the upper end of a tubing spool or annulus 14 which in turn is similarly mounted on a casing spool 16 and casing head 18. Concentric inner and outer mandrels 20, 22 respectively are supported in the steel body 12 by means to be described and the inner mandrel 20 is axially movable with respect to the outer mandrel 22. A pack off seal 24 is provided on the lower end of the outer mandrel 22 and an expander nipple 26 is provided on the lower end of the inner mandrel 20. As will be subsequently described, pressure responsive means in the form of a piston 28 which is secured adjacent the upper end of the inner mandrel 20 linearly moves the inner mandrel upwardly with respect to the outer mandrel in response to hydraulic pressure fed to the underside of piston 28 so that the expander nipple 26 will apply outward and upward pressure against the pack off seal 24 and thereby seal off the upper end of the casing. A lock nut 30 is provided for locking the inner mandrel in position relative to the outer mandrel.

Figure 2:
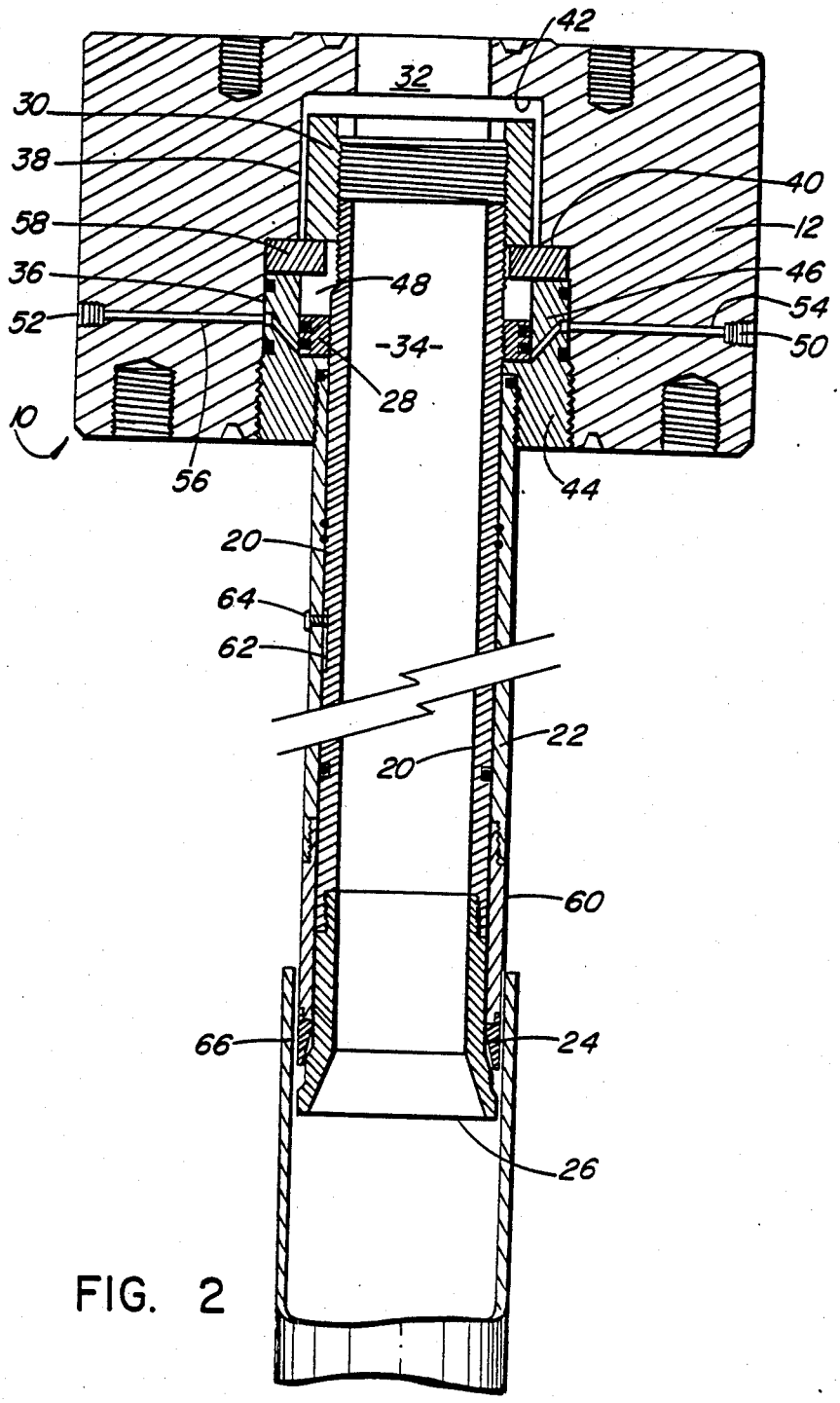
FIG. 2 is a cross sectional view in greater detail of the present invention in an unset or running position.

Turning now to FIG. 2, the body 12 has a central passageway 32 in its upper end and a large cavity indicated generally at 34 defined by pair of concentric bores 36, 38, for receiving the upper ends of the mandrels 20 and 22. The bores 36, 38 provide first and second cylindrical shoulders 40 and 42.

Bore 36 is threaded to receive a threaded hub 44, the hub having a cylindrical wall portion 46 which is spaced from the inner mandrel 20 to provide a circumferential chamber 48. As shown in FIG. 1, piston 28 is in the form of a ring which is threadably engaged on the upper portion of the inner mandrel 20 and the chamber 48 is in communication with inlet and outlet ports 50 and 52 by drilled passageways 54 and 56 in the body 12 and in the hub 44. A stop ring 58 of substantial thickness sits on the shoulder 40 of the first bore 36, secured therein by the threaded hub 44 and it provides a stop means for the lock nut 30 which is threadably mounted on the upper end of the inner mandrel 20 and is free to axially move in the second bore 38.

The upper end of the outer mandrel 22 is threadably secured in the hub 44, the lower end of the outer mandrel being provided with a removable outer nipple 60 on which the seal member 24, preferably of deformable rubber, is located. The expander nipple 26 is removably secured on the lower end of the inner mandrel 20 as clearly illustrated.

A grooved key slot 62 is provided in the wall of the inner mandrel 20 and a key bolt 64 is located in the wall of the outer mandrel 22 and extends therethrough into the key slot 62 to prevent the the inner mandrel from rotating with respect to the outer mandrel.

Figure 3:
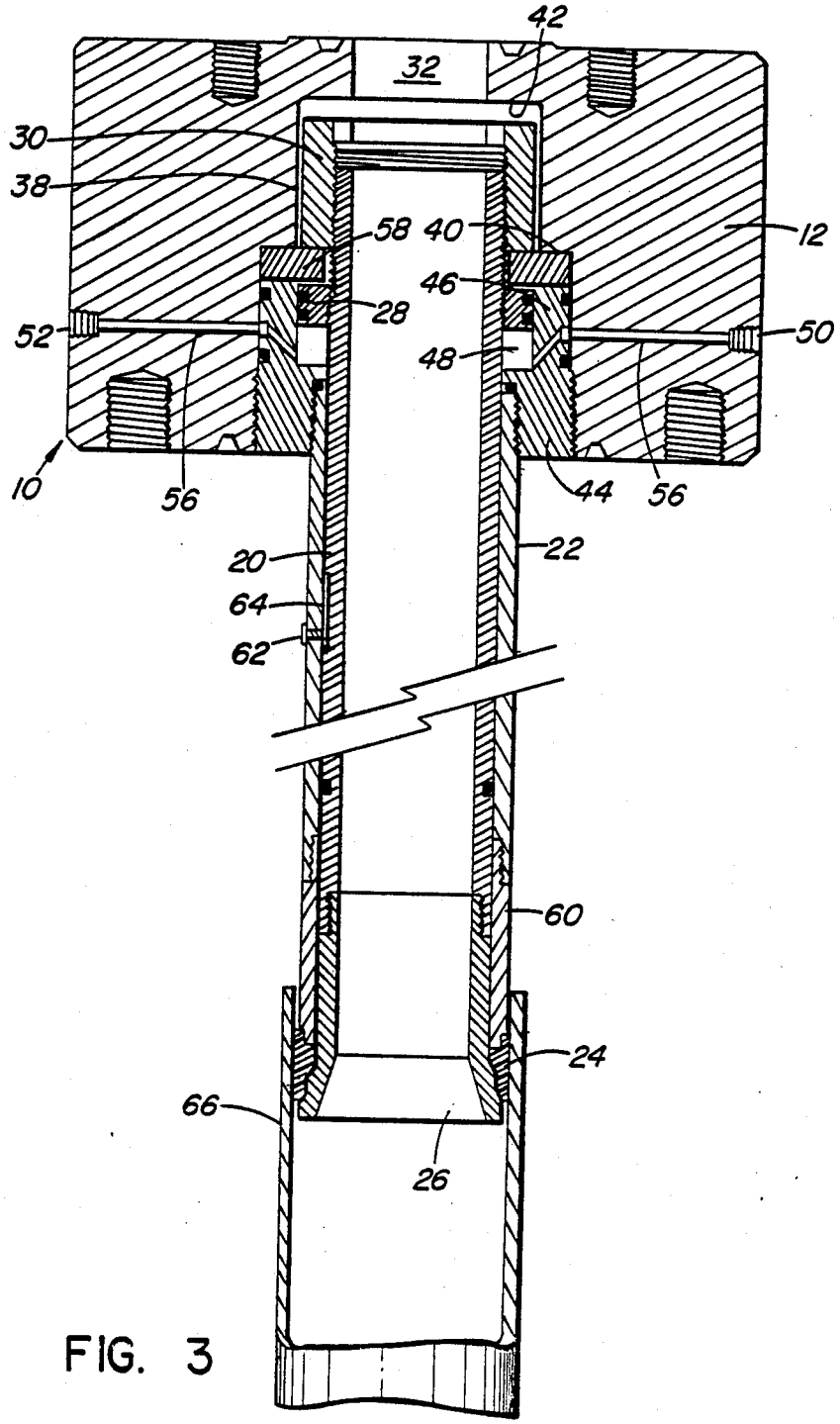
FIG. 3 is a view similar to FIG. 2 but shows the apparatus in the set position.

As shown in FIG. 3, in response to fluid fed into the chamber 48 through inlet port 50 and passageway 54, the piston 28 raises the inner mandrel 20 so that the seal expanding means 26 engages the inner circumference of the sealing member 24 to apply upward and outward pressure thereon so that the seal firmly engages the inner wall of the well casing 66.

The packer 10 is shown in FIG. 2 in the unset or running position. Hydraulic fluid from an outside source, not shown, is pumped into the inlet port 50 while the exhaust port 52 is left open so as to bleed off any air in the chamber 48. Port 52 is then closed with a valve, not shown. The hydraulic flow now acts on the piston 28 and, as previously described, piston 28 and the inner mandrel 20 to which it is attached is moved upwards. The locking nut 30 on the upper end of the inner mandrel 20 also moves upwardly away from the stop ring 58, this movement causing the expander nipple 26 to force the sealing member 24 outwardly against the inner wall of the casing 66. The hydraulic pressure at inlet port 50 is monitoried and, when it reaches a precalculated value, the pump is stopped. The lock nut 30 is then slowly rotated downwards with a suitable lug wrench, not shown. The elements of the apparatus are then in a position shown in FIG. 3. The lock nut 30 is then tightened down against the stop ring 48 thereby holding the inner mandrel 20 and its attached expander nipple 26 in this position. It will be noted that in FIG. 3 that the piston 28 does not come up against the lower surface of the stop ring 48 and, if it did, the sealing member 24 would not necessarily be completely set and accordingly the next upward size of outer nipple would be used.

It will be appreciated that the hydraulic pressure to be monitored at the inlet port 50 is related to the sealing pressure developed at the sealing member 24. This is calculated in view of the parameters of the servicing job to be done on the site and of course can be different for every job.

The packer 10 is now set and the hydraulic pressure at inlet port 50 can be released. The fluid or slurry can now be pumped downwardly through the central aperture 32 and through the inner mandrel 20 and into the long string casing 66. The tubing spool will see no pressure from this fluid. If it is required, prior to servicing, that a pressure check be made on the area of the sealing member 24 only a small amount of fluid need be pumped into the annulus volume 68, FIG. 1, through an annulus valve 70 and pressured up to see if the seal 24 leaks. If it does, taking the complete tool 10 out and resetting it is not a time consuming job.

To release the apparatus, the port 52 is opened and the lock nut 30 is rotated away from the stop ring 48 and up against the second shoulder 42. This forces the inner mandrel 20 downwardly, thus disengaging the expander nipple 26 from the sealing member 24. The entire tool may now be removed from the wellhead by undoing appropriate flange nuts and the like.

Those skilled in the art will appreciate that various features, characteristics and advantages of the present invention have been set forth herein or are readily realizable from the detailed description of the preferred embodiment. However, the disclosure is illustrative and various changes may be made while utilizing the principles of the present invention and falling within the scope of the invention as expressed in the appended claims.

The embodiments of the invention in which an exclusive property or privilege is claimed are defined as follows:

1. A short-coupled well casing packer comprises a body adapted for external mounting on a casing head, tubing spool or the like;

concentric inner and outer mandrels supported in said body, said outer mandrel being adapted to be restrained to the casing head and said inner mandrel being movable axially with respect to said outer mandrel;

high pressure seal means on the lower end of said outer mandrel for circumferentially sealing against the inner wall of the casing; means on the lower of end of said inner mandrel for engaging and expanding said seal means;

hydraulic pressure responsive means in said body and secured to said inner mandrel for linearly moving said inner mandrel with respect to said outer mandrel;

and means for locking said inner mandrel in position relative to said outer mandrel.

2. A packer according to claim 1 wherein said body has a central passageway in its upper end and a cavity defined by a pair of concentric bores for receiving the upper ends of said mandrels therein; first and second cylindrical shoulders defined by said bores; a hub member secured in said first bore and having a cylindrical wall portion spaced from said inner mandrel to define a chamber; said hydraulic pressure responsive means comprising a piston located in said chamber and secured to said inner mandrel; inlet and outlet ports in said body and hub communicating with said chamber; a stop ring in said first bore, intermediate said hub and said first shoulder; a lock nut in said shoulder bore, intermediate said stop ring and said second shoulder;

said inner mandrel having its upper end threadably engaged in said lock nut and the upper end of said outer mandrel being secured in said hub;

said piston being adapted, in response to fluid fed into said chamber below said piston, to raise said inner mandrel in said cavity so that said seal expanding means engages and expands said seal means on the lower end of the outer mandrel to engage the inner wall of said casing.

3. A short-coupled well casing packer comprising:

a body adapted for external mounting on a casing head, tubing spool or the like;

said body having a central passageway in its upper end and a cavity defined by a pair of concentric bores, first and second cylindrical shoulders defined by said bores, and a hub member secured in a first of said bores and having a cylindrical wall portion;

concentric inner and outer mandrels supported in said body, with the upper ends of said mandrels extending inward of said body bores, said inner mandrel being movable axially, with respect to said outer mandrel;

a hub member secured in said first bore having a cylindrical wall portion spaced from said inner mandrel to define a chamber and securing the upper end of said outer mandrel;

seal means on the lower end of said outer mandrel for circumferentially sealing against the inner wall of the well casing, means on the lower end of said inner mandrel for engaging and expanding said seal means;

hydraulic pressure responsive means in said body and secured to said inner mandrel for linearly moving said inner mandrel with respect to said outer mandrel; said hydraulic pressure responsive means comprising a piston located in said chamber and secured to said inner mandrel; inlet and outlet ports in said body and hub communicating with said chamber; a stop ring in said first bore, intermediate said hub and said first shoulder; said piston being adapted, in response to fluid fed into said chamber below said piston, to raise said inner mandrel in said cavity so that said seal expanding means engages and expands said seal means on the lower end of the outer mandrel to engage the inner wall of the casing; and locking means for locking said inner mandrel in position relative to said outer mandrel and including a lock nut in the second of said bores intermediate said stop ring and said second shoulder threadably engaged with the upper end of said inner mandrel.

* * * * *